US010702004B2

(12) United States Patent
Gagliardo et al.

(10) Patent No.: US 10,702,004 B2
(45) Date of Patent: Jul. 7, 2020

(54) BASEBALL HELMET WITH VISOR

(71) Applicant: Visor Nation Inc., Lincolnwood, IL (US)

(72) Inventors: Michael Edmund Gagliardo, Glenview, IL (US); Christopher Mark Serritella, Lincolnwood, IL (US); Marcus Bosch, Chicago, IL (US); Jeffrey Clayton Simonson, Menomonie, WI (US)

(73) Assignee: VISOR NATION INC., Lincolnwood, IL (US)

( * ) Notice: Subject to any disclaimer, the term of this patent is extended or adjusted under 35 U.S.C. 154(b) by 0 days.

(21) Appl. No.: 15/845,824

(22) Filed: Dec. 18, 2017

(65) Prior Publication Data

US 2018/0295924 A1 Oct. 18, 2018

Related U.S. Application Data

(60) Provisional application No. 62/484,657, filed on Apr. 12, 2017.

(51) Int. Cl.

| | |
|---|---|
| ***A42B 3/22*** | (2006.01) |
| ***A42B 3/04*** | (2006.01) |
| ***A42B 3/18*** | (2006.01) |

(52) U.S. Cl.

CPC ..... *A42B 3/226* (2013.01); *A42B 3/04* (2013.01); *A42B 3/0406* (2013.01); *A42B 3/185* (2013.01)

(58) Field of Classification Search

CPC ..... A42B 1/062; A42B 3/222; A42B 3/227; A42B 3/221; A42B 3/223; A42B 3/185; A42B 3/226; A42B 3/22; A42B 3/228; A42B 3/04; A42B 3/20; A42B 3/225; A42B 3/324

See application file for complete search history.

(56) References Cited

U.S. PATENT DOCUMENTS

| | | | | | |
|---|---|---|---|---|---|
| 1,660,375 | A * | 2/1928 | Dieterle | A42B 3/00 | 2/423 |
| 1,673,859 | A * | 6/1928 | Wittcoff | A42B 1/02 | 2/10 |
| 1,695,596 | A * | 12/1928 | Levinsky | A42B 1/062 | 2/10 |
| 1,864,104 | A * | 6/1932 | Till | A42B 3/06 | 2/412 |
| 2,179,719 | A * | 11/1939 | Goskey | A42B 1/062 | 2/10 |
| 2,248,331 | A * | 7/1941 | Blodjer | A42B 1/062 | 2/10 |

(Continued)

OTHER PUBLICATIONS

International Preliminary Report on Patentability (7 pages) dated Oct. 15, 2019 from related PCT Application PCT/US2017/033470.

(Continued)

*Primary Examiner* — Sally Haden
(74) *Attorney, Agent, or Firm* — Brinks, Gilson & Lione; John C. Freeman

(57) ABSTRACT

A helmet including a hard shell defining an exterior surface and an interior volume of space and including a bill. A visor including an engagement structure that is releasably attached to the bill wherein the visor does not pivot relative to the bill when engaged with the bill.

14 Claims, 17 Drawing Sheets

(56) References Cited

U.S. PATENT DOCUMENTS 2,328,687 A * 9/1943 Serr ..... A42B 1/062 2/10
2,481,960 A * 9/1949 Wall ..... A42B 1/062 16/257
2,533,626 A * 12/1950 Reiter ..... A42B 1/062 16/257
2,560,669 A 7/1951 Vaca
2,610,355 A * 9/1952 Becker ..... A42B 1/062 16/224
2,677,853 A * 5/1954 Ross ..... A42B 1/062 16/235
2,690,586 A * 10/1954 Van Buren, Jr. ..... A42B 1/062 16/296
3,016,545 A * 1/1962 Donahue ..... A42B 1/062 2/10
3,067,427 A 12/1962 McClintock, Sr.
3,330,051 A * 7/1967 Pambello ..... A42B 1/062 2/12
3,631,540 A 1/1972 Penny
4,170,792 A 10/1979 Higgs
4,210,972 A * 7/1980 Baclit ..... A42B 1/062 2/10
4,321,708 A * 3/1982 Troiano ..... A42B 1/062 2/10
4,766,609 A 8/1988 Lane
4,850,049 A * 7/1989 Landis ..... A42B 1/043 2/10
4,885,806 A 12/1989 Heller
5,035,004 A * 7/1991 Koester ..... A42B 1/004 2/10
5,056,164 A * 10/1991 Lisle ..... A42B 1/062 2/453
5,220,689 A 6/1993 Miller
5,261,124 A 11/1993 Day
5,379,491 A * 1/1995 Solo ..... A42B 1/247 224/901.2
5,396,661 A 3/1995 Sutter et al.
5,412,812 A * 5/1995 Gatchalian ..... A42B 1/247 2/10
5,533,207 A * 7/1996 Diaz ..... A42B 1/247 2/10
5,544,361 A * 8/1996 Fine ..... A42B 1/062 2/10
5,577,271 A * 11/1996 Davis ..... A01K 55/00 2/10
5,692,234 A 12/1997 Yuen
5,720,040 A * 2/1998 Simone ..... A42B 1/247 2/10
5,813,048 A 9/1998 Thom
5,819,318 A 10/1998 Tse
5,826,271 A * 10/1998 Garrett ..... A42B 1/247 2/10
5,987,640 A * 11/1999 Ryder ..... G02C 3/02 2/10
6,173,447 B1 1/2001 Arnold
6,174,058 B1 * 1/2001 Hsiao ..... A42B 1/062 2/10
6,244,706 B1 * 6/2001 Maher ..... A42B 1/247 2/10
6,481,060 B1 * 11/2002 Tsai ..... A42B 1/062 2/10
6,807,679 B1 10/2004 Wang-Lee
6,935,741 B2 * 8/2005 Denney ..... A42B 1/247 2/10
6,959,989 B2 * 11/2005 Holm ..... A42B 3/185 2/10
6,996,852 B1 * 2/2006 Cabrera ..... A42B 1/062 2/171
7,082,618 B1 * 8/2006 Muso ..... A42B 1/062 2/175.1
7,225,471 B2 6/2007 Sutter et al.
7,240,374 B2 * 7/2007 Fang ..... A42B 1/247 2/10
7,340,781 B2 * 3/2008 Clark ..... A42B 1/247 2/209.13
7,344,241 B2 * 3/2008 Baek ..... A42B 1/247 2/10
7,403,346 B2 7/2008 Reichow et al.
7,551,360 B2 6/2009 Reichow et al.
7,908,668 B2 3/2011 Folkesson
D636,009 S * 4/2011 Hunt ..... D16/306
7,926,938 B2 * 4/2011 Lu ..... G02C 3/02 2/10
8,032,946 B2 10/2011 Ishikawa
8,082,600 B2 12/2011 Morin
8,191,175 B1 * 6/2012 White ..... A42B 1/18 2/175.1
8,210,676 B1 * 7/2012 Hunt ..... G02C 3/02 2/209.13
8,286,269 B2 10/2012 Springer et al.
8,286,270 B2 10/2012 Higgins
8,291,513 B2 10/2012 Prinkey
8,819,871 B2 9/2014 Maddux et al.
9,032,548 B2 5/2015 Isobe
9,125,447 B2 9/2015 Lebel et al.
9,179,726 B2 * 11/2015 Hanover ..... A42B 1/24
9,265,297 B2 2/2016 Warmouth et al.
9,609,902 B2 * 4/2017 Waters ..... A42B 1/24
9,833,032 B2 * 12/2017 Jacobsen ..... A42B 3/12
2004/0158912 A1 * 8/2004 DeWinter ..... A42B 1/062 2/195.1
2005/0257310 A1 * 11/2005 Jang ..... A42B 1/062 2/209.13
2006/0037125 A1 * 2/2006 McDowell ..... A42B 1/247 2/209.13
2006/0109420 A1 5/2006 Holm
2006/0242751 A1 * 11/2006 Koo ..... A42B 1/062 2/171
2007/0033775 A1 2/2007 Hsiao
2007/0192933 A1 8/2007 Kam
2007/0256214 A1 * 11/2007 Mcgowan ..... A42B 1/247 2/209.13
2008/0000016 A1 1/2008 Kellogg
2009/0013439 A1 1/2009 Thoman
2012/0110718 A1 * 5/2012 Kim ..... A42B 1/065 2/209.12
2013/0326791 A1 * 12/2013 Woo ..... A42B 1/18 2/172
2016/0050990 A1 * 2/2016 Hayes ..... A42B 1/02 2/9
2017/0071278 A1 * 3/2017 Schulz ..... A42B 1/045
2018/0042324 A1 * 2/2018 King ..... A42B 1/062
2018/0052334 A1 * 2/2018 Repko ..... G02C 3/02
2018/0206575 A1 * 7/2018 Dotzenrod ..... A42B 1/24

OTHER PUBLICATIONS

International Preliminary Report on Patentability (6 pages) dated Oct. 15, 2019 from related PCT Application PCT/US2018/026221.
International Search Report and Written Opinion of the International Searching Authority in corresponding PCT Application No. PCT/US2017/033470.

* cited by examiner

BASEBALL HELMET WITH VISOR

This application claims the benefit of priority under 35 U.S.C. § 119(e)(1) of U.S. Provisional Application Ser. No. 62/484,657, filed Apr. 12, 2017, the entire contents of which are incorporated herein by reference.

FIELD OF THE INVENTION

The present invention is directed to a helmet that includes a detachable visor.

BACKGROUND OF THE INVENTION

Baseball is a game commonly played outdoors. On those occasions when the sun is out, batters can experience the glare of the sun when trying to hit a pitched baseball. Some baseball players have tried to counteract the glare of the sun while batting by wearing sunglasses. However, the frame of the glasses can partially obscure the baseball as it is travelling toward the batter.

It would be helpful to provide a way to counteract glare from the sun while batting at a pitched baseball and at the same time provide an unobstructed view of the pitched baseball.

SUMMARY OF THE INVENTION

One aspect of the present invention regards a helmet including a hard shell defining an exterior surface and an interior volume of space and including a bill. A support structure attached to an underside of the bill. A visor including an engagement structure that is releasably attached to the support structure, wherein when the visor engages the support structure the visor does not pivot relative to the support structure.

A second aspect of present invention regards a helmet including a hard shell defining an exterior surface and an interior volume of space and including a bill. A visor including an engagement structure that is releasably attached to the bill, wherein the visor does not pivot relative to the bill when engaged with the bill.

A third aspect of the present invention regards a method of using a helmet that includes a releasable visor, the method including during an at bat, wearing on a head of a user a baseball helmet made of a hard material and that has a bill to which a visor is releasably attached, wherein when the visor is engaged with the bill, the visor does not pivot relative to the bill. After the at bat, removing the visor, from the bill.

A fourth aspect of the present invention regards a helmet including a hard shell defining an exterior surface and an interior volume of space and a visor that is directly attached to the hard shell in a spring-loaded manner.

A fifth aspect of the present invention regards a helmet including a hard shell defining an exterior surface and an interior volume of space and a visor that is attachable to the hard shell at multiple discrete and incremental positions along a linear direction.

A sixth aspect of the present invention regards a helmet including a hard shell defining an exterior surface and an interior volume of space and including a bill, wherein the hard shell has an arcuate slot formed therein at a rear portion of the bill. The helmet further including a visor that is attached to the hard shell in such a manner so as to rotate about an axis that intersects sides of the hard shell that are opposite to each other, wherein the visor includes a stop that engages said hard shell so as to prevent further rotation of the visor and limit an amount the visor extends below the bill, and wherein when the visor rotates a portion thereof passes through the slot.

One or more aspects of the present invention provide the advantage of providing a clear view of a baseball for a batter when there is glare from the sun present.

One or more aspects of the present invention provide the advantage of easily attaching or removing a visor from a helmet.

BRIEF DESCRIPTION OF THE DRAWINGS

The various features, advantages and other uses of the present apparatus will become more apparent by referring to the following detailed description and drawing in which.

DETAILED DESCRIPTION

As shown in the exemplary drawing figures, a baseball helmet is shown, wherein like elements are denoted by like numerals.

Figure 1:
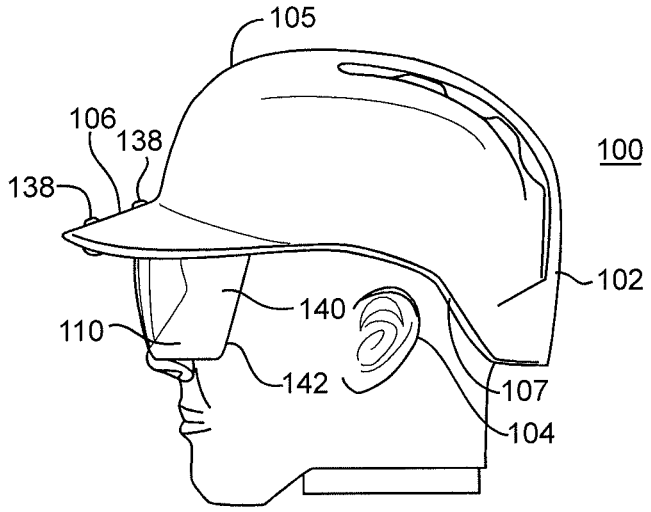
FIG. 1 is a left side view of an embodiment of a baseball helmet that includes a visor in accordance with the present invention.
Figure 2:
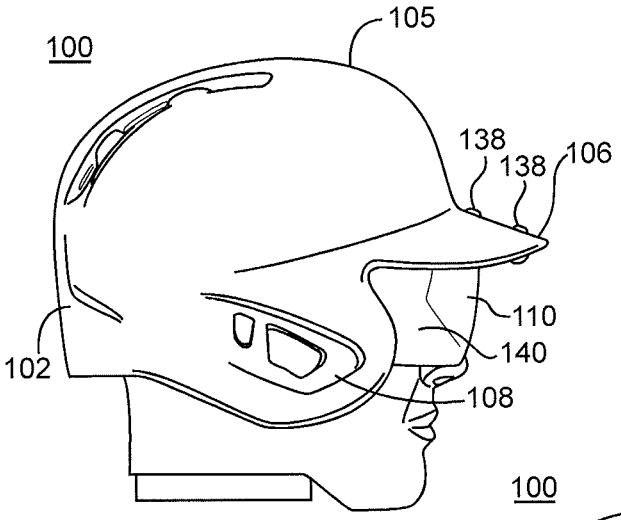
FIG. 2 is a right side view of the baseball helmet and visor of FIG. 1.

FIGS. 1-3 and 5-8 show an embodiment of a baseball helmet 100. The baseball helmet 100 includes a hard shell 102 placed on the head 104 of a baseball player. The shell 102 defines an exterior surface 105 and an interior volume of space 107. As shown, the shell 102 includes a front bill 106 positioned at the front of the shell 102. As shown in FIG. 2, the shell 102 can include an earflap 108 typically positioned on the side of the helmet 100 that will face the pitcher when the batter wearing the helmet 100 is in the batter's box. Of course, the shell 102 can include two earflaps, one for each ear.

The shell 102 is preferably made of a durable material, such as carbon fiber, so as to offer protection to the batter should he be struck by the pitched baseball. It should be understood that the present invention regarding the helmet of FIGS. 1-3 and 5-8 and the other inventions regarding the helmet of FIGS. 4 and 9-40 are not constrained to use the helmet designs shown. It is envisioned that most, if not all, types of baseball helmets can be used in conjunction with the inventions disclosed in FIGS. 1-40. In addition, it is envisioned that the inventions disclosed in FIGS. 1-40 can be adapted for use with other sports, such as cricket.

The baseball helmet 100 includes a visor 110 attached to the front bill 106. The visor 110 is preferably made of a durable material, such as a polycarbonate that is injection molded. The material can be either clear/transparent or tinted to aid in reducing glare from the sun. The visor 110 has a height, H, of approximately 3.98 inches and a length, L, of approximately 6.45 inches. The radius of curvature chosen for the optical portion 111 of the visor 110 depends on the optical characteristics to be conveyed to the player wearing the visor 110. As shown in FIGS. 3 and 5-8, a central portion of the top of the visor 110 includes an integrally attached engagement structure, such as a visor grip 112 that has a heavier texture than the rest of the visor 110. The side ends 113 of the optical portion 111 of the visor 110 extends away from the rear 115 of visor grip 112 by a distance, D, of approximately 3.34 inches. The visor grip 112 is made of the same material as the rest of the visor 110. The visor grip 112 has a length of approximately 1.25 inches and extends past the main, optical portion of the visor 110 by approximately 0.72 inches.

Figure 5:
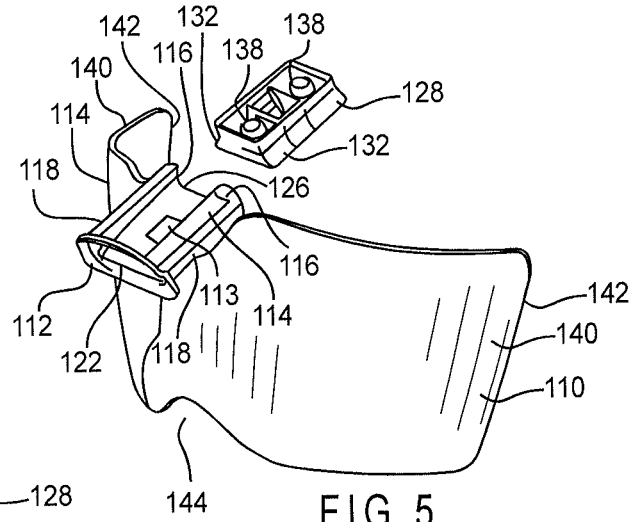
FIG. 5 is a left, top perspective, exploded view of the visor shown in FIG. 1.
Figure 6A:
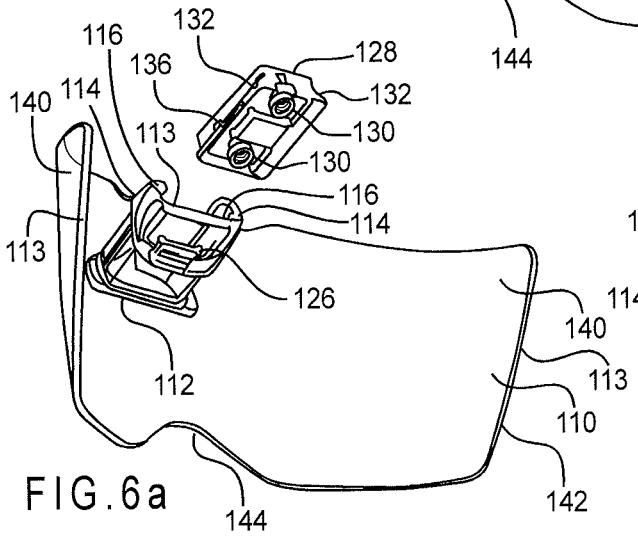
FIG. 6*a* is a left, rear perspective, exploded view of the visor shown in FIG. 1.
Figure 6B:
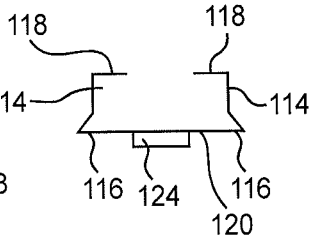
FIG. 6*b* schematically shows a cross-sectional view of visor grip of the visor of FIG. 1.
Figure 7A:
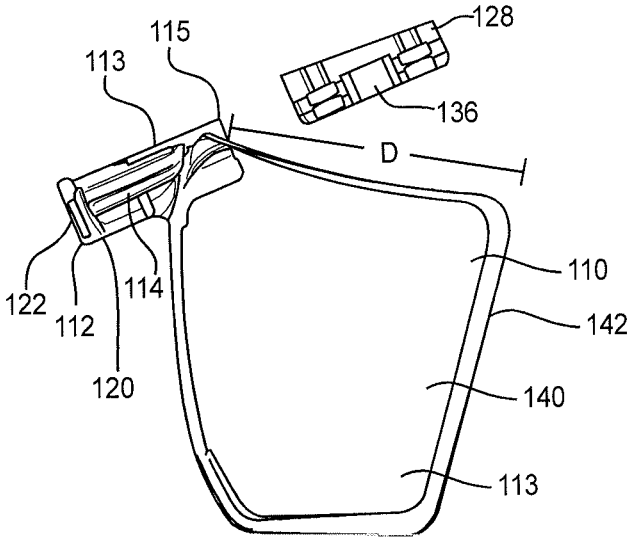
FIG. 7*a* is a left, exploded view of the visor shown in FIG. 1.
Figure 7B:
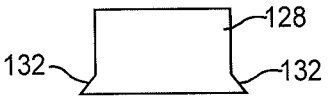
FIG. 7*b* is a front schematic view of a bracket to be used with the helmet of FIG. 1.
Figure 8:
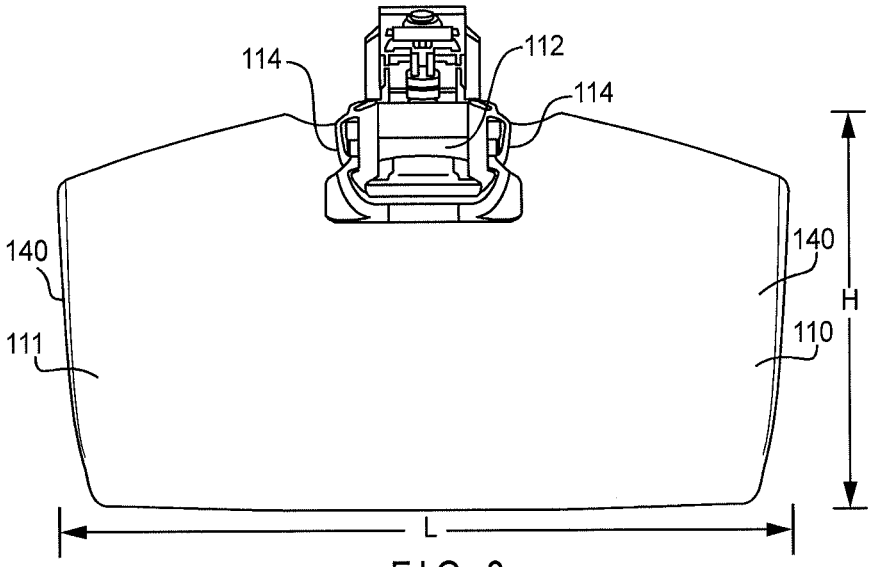
FIG. 8 is a front view of the visor shown in FIG. 1.
Figure 9:
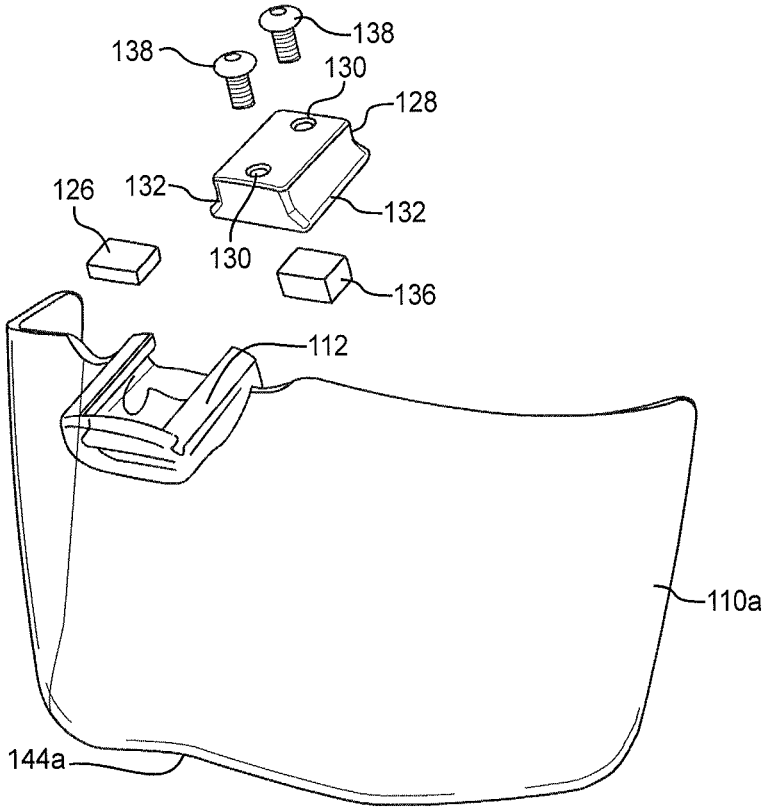
FIG. 9 is a left, perspective, exploded view of a third embodiment of a visor to be used with the support structure and baseball helmet of FIG. 1.
Figure 10:
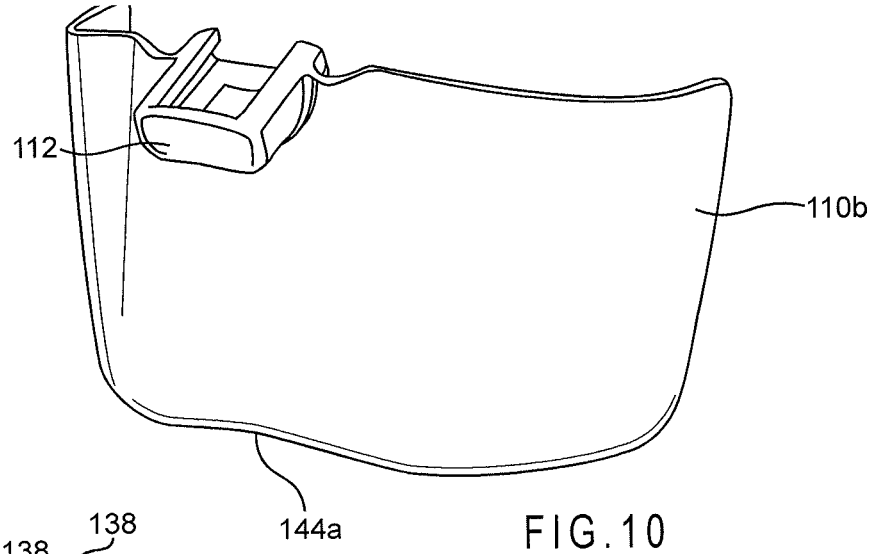
FIG. 10 is a left, top perspective view of the visor shown in FIG. 9.
Figure 11:
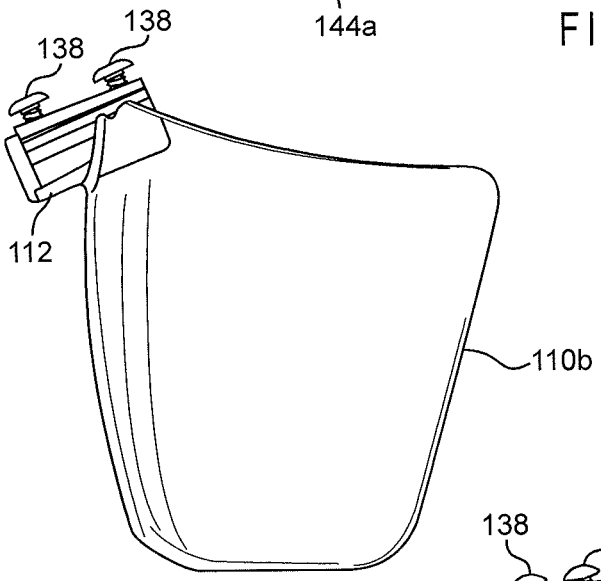
FIG. 11 is a left, side view of the visor shown in FIG. 9 when the support structure of FIG. 9 of the helmet is inserted.
Figure 12:
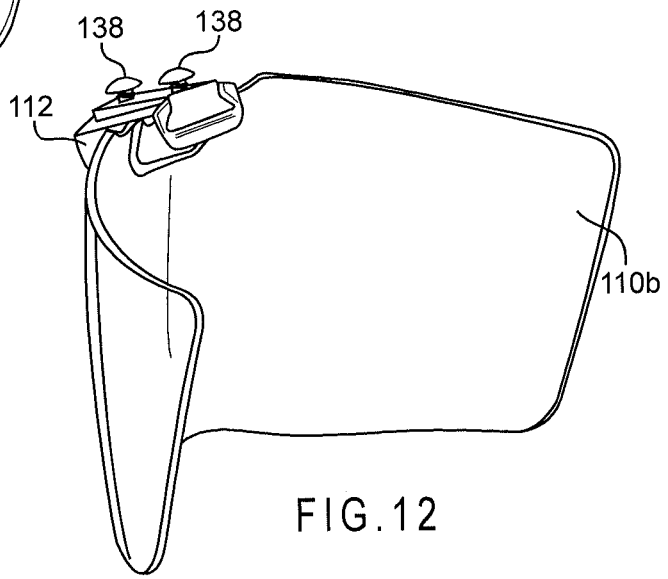
FIG. 12 is a left, rear perspective view of the visor and support structure of FIG. 11.
Figure 13:
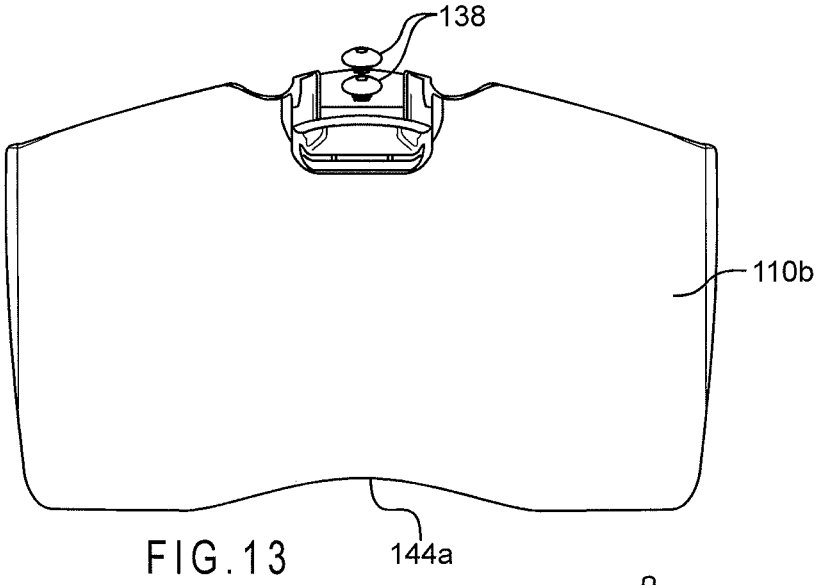
FIG. 13 is a front view of the visor and support structure of FIG. 11.
Figure 14:
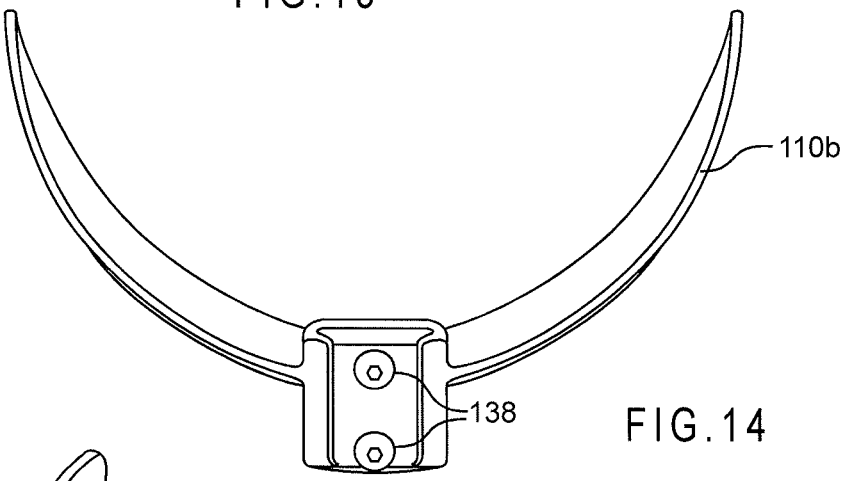
FIG. 14 is a top view of the visor and support structure of FIG. 11.
Figure 15:
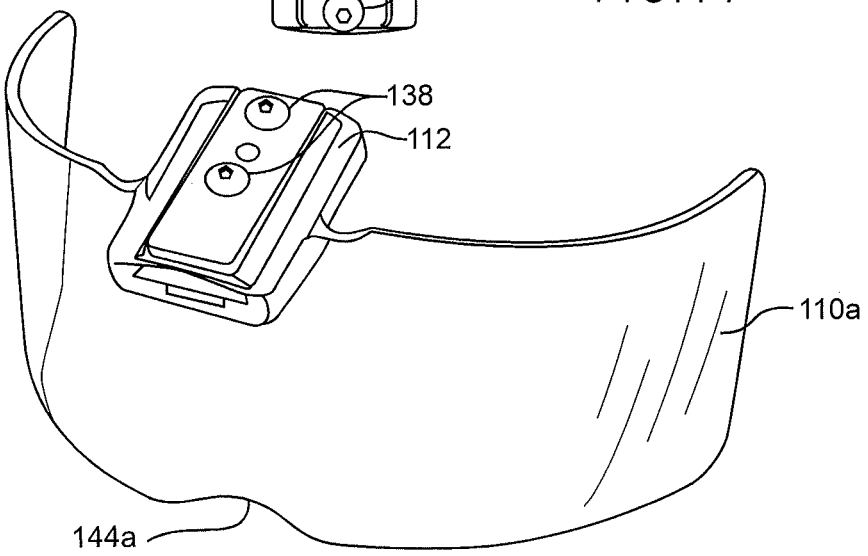
FIG. 15 is a left, perspective view of the visor and support structure of FIG. 11 when the visor is tinted.
Figure 17:
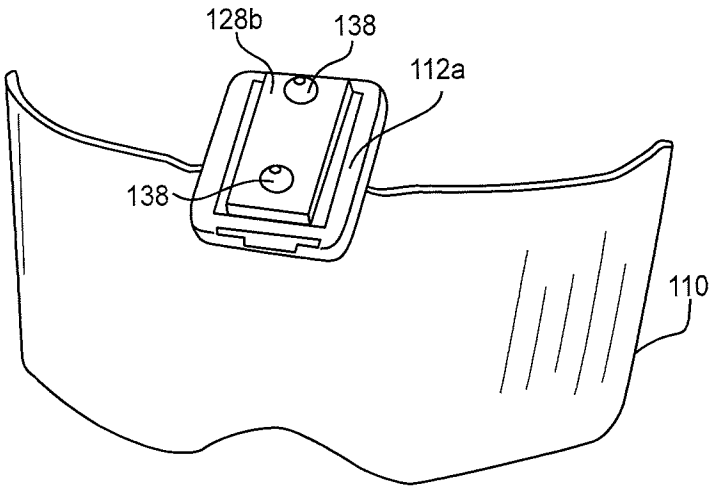
FIG. 17 is a left, top perspective view of a third embodiment of a visor and attachment mechanism to a baseball helmet in accordance with the present invention.
Figure 16:
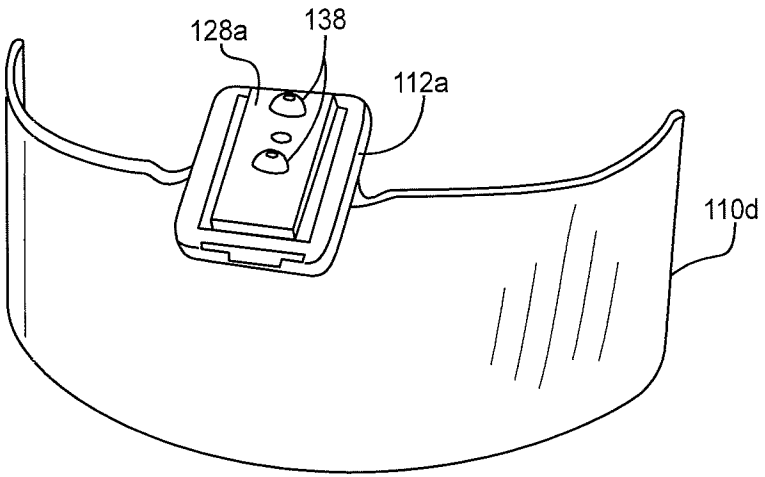
FIG. 16 is a left, top perspective view of a second embodiment of a visor and support structure for attachment to a baseball helmet in accordance with the present invention.

As shown in FIGS. 5 and 6*a-b*, the visor grip 112 defines a slot 113, wherein the interior of the side walls 114 of the visor grip 112 has a pair of identically triangularly shaped grooves 116. The side walls 114 are integrally attached to identically shaped horizontal top ledges 118 and a bottom horizontal surface 120. In addition, the ledges 118, side walls 114, and bottom surface 120 are integrally attached to a front wall 122 that is perpendicular to the bottom surface 120 and the side walls 114. The front wall 122 closes one end of the slot 113. The bottom surface 120 of the visor grip 112 has an indentation 124 that receives a magnet 126 that is adhesively attached to the bottom surface 120.

As shown in FIGS. 5-8, a support structure is attached to the underside of the bill 106. An example of such a support structure is bracket 128. As shown in FIG. 6*a*, bracket 128 has a pair of holes 130 drilled at two ends of the bracket 128. The holes are spaced from each other by approximately 0.75 inches. The bracket 128 includes a pair of equally shaped ramped surfaces 132. The surfaces 132 are shaped similar to grooves 116 of the visor grip 112. In the underside 134 of the bracket 128, a centrally located indentation is formed that entirely receives a magnet 136 that is attached to the underside 134 via an adhesive. Thus, when the bracket 128 is attached to the underside of the front bill 106, the magnet 136 is spaced from the front bill 106. The bracket 128 is made of a durable material, such as 6061 Aluminum (CNC). A schematic front view of the bracket 128 is shown in FIG. 7*h*.

Along a central line that bisects the front bill 106 of the helmet 100, a pair of holes are drilled in the front bill 106. The size of the pair of holes of the front bill 106 is similar to the size of the holes 130 of the bracket 128. The pair of holes of the front bill 106 are spaced from each other a distance that is the same as the separation distance between holes 130 of the bracket 128.

Figure 3:
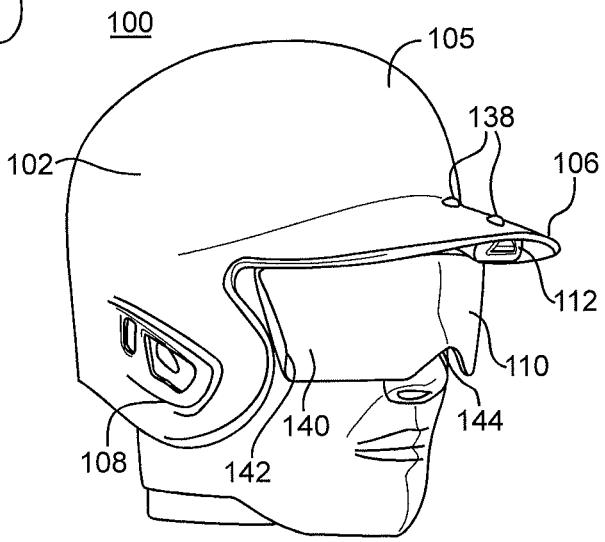
FIG. 3 is a right perspective view of the baseball helmet and visor of FIG. 1.

With the above description of the visor grip 112 and the bracket 128 in mind, attachment between the visor 110 and the front bill 106 is now discussed. In particular, the bracket 128 is entirely inserted into slot 113 of the visor grip 112 so that the surfaces 132 of the bracket 128 snugly engages the grooves 116 of the visor grip 112. In additions, an attractive force between magnets 126 and 136 is established. At this point, the holes 130 of the bracket 128 are aligned with the holes drilled in the front bill 106 and then button head cap screws (#10-24) 138 are inserted into the holes of the front bill 106 and engage the holes 130 of the bracket 128. Thus, the visor 110 is attached to the front bill 106 and is unable to pivot relative to the bill 106. When so attached and when a person places the helmet 100 on his or her head 104, the side ends 140 of the visor 110 curve around the face of the player so that the side edges 142 of the ends 140 extend past the eye socket and toward the rear portion of the helmet 100 as shown in FIGS. 1-3.

If the visor 110 has a bottom recess 144 as shown in FIGS. 1-3 and 5-8, the recess is preferably spaced above and positioned symmetrically with respect to a nose of a person wearing the helmet. The recess 144 is positioned so that the nose does not touch the visor 110. Note that the amount the recess 144 exposes the nose can vary as shown when comparing the recess of FIGS. 1-3 and 5-8 and the recess 144*a* of the visors 110*a-b* of FIGS. 9-15. Note that the visors 110*a* (FIGS. 9 and 15) and 110*b* (FIGS. 10-14) are identical in all aspects except visor 110*a* is tinted while visor 110*b* is clear. In addition, visors 110*a* and 110*b* each includes a visor grip 112 like that of FIGS. 1-3 and 5-8 and the visor grips 112 of the visors 110*a-b* engage a bracket 128 attached to the bill 106 of a shell 102 in the manner described with respect to the embodiment of FIGS. 1-3 and 5-8 so as to form part of baseball helmets.

Figure 4:
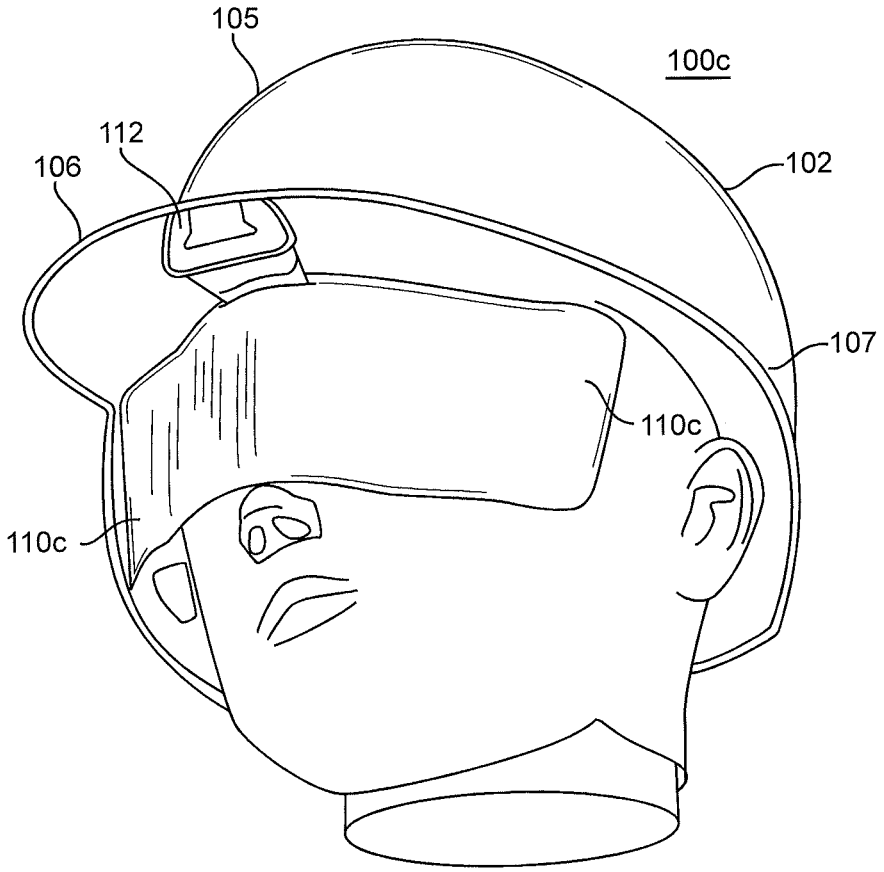
FIG. 4 is a left perspective view of the baseball helmet of FIG. 1 when a second embodiment of a visor is used.

Since the visor 110*c* does not have a bottom recess as shown in FIG. 4, the middle portion of the bottom of the visor 110*c* is preferably spaced in front of and aligned with the bottom of nose of a person wearing the helmet 100*c*. Note that the visor 110*c* includes a visor grip 112 like that of FIGS. 1-3 and 5-8 and the visor grip 112 of the visor 110*c* engages a bracket 128 attached to the bill 106 of a shell 102 in the manner described with respect to the embodiment of FIGS. 1-3 and 5-8 so as to form part of a baseball helmet.

The attached visors 110 and 110*a-c* of the helmets of FIGS. 1-3 and 5-8 can be removed from the front bill 106 by sliding the visor 110 until the bracket 128 is removed from the grooves 116 of the visor grip 112.

Note that other variations for the bracket 128 and the visor grip 112 of the embodiments of FIGS. 1-15 are possible. For example, the length of the bracket 128 and visor grip 112 can be lengthened as shown by the brackets 128*a-b* and visor grip 112*a* in FIGS. 16 and 17. The spacing of the holes 130 of the brackets 128 and 128*a-b* can be varied along with the holes drilled into the bill 106 in the helmet. Attachment between the brackets 128*a-b* and the bill 106 is performed in the same way that the bracket 128 is attached to the bill 106 via screws 138. Note that bracket 128*a* can be used for attachment of a visor 110*d* to a helmet and bracket 128*b* can be used for attachment of a visor 110 to a helmet. Other shapes for the brackets 128 and 128*a-b* can be used, such as trapezoidal, and triangular shapes. Materials for the brackets 128 and 128*a-b* are durable, such as plastic, aluminum, carbon fiber and steel.

Figure 18:
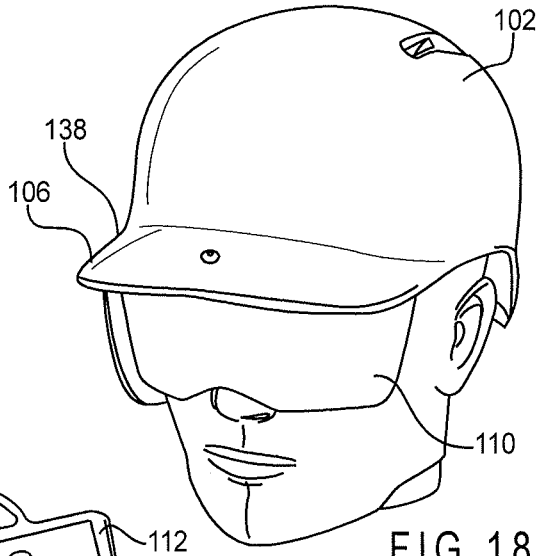
FIG. 18 is a left perspective view of a fourth embodiment of a visor and attachment mechanism to a baseball helmet in accordance with the present invention.

Another variation of the helmet of FIGS. 1-3 and 5-8 is shown in FIG. 18, wherein the bracket 128 is altered so that only a single hole is formed and so only a single hole in the front bill 106 is formed so as to be aligned with the single hole of the bracket 128. A single screw is inserted into the aligned holes so that the bracket 128 of FIG. 18 is attached to the underside of the front bill 106.

Figure 19:
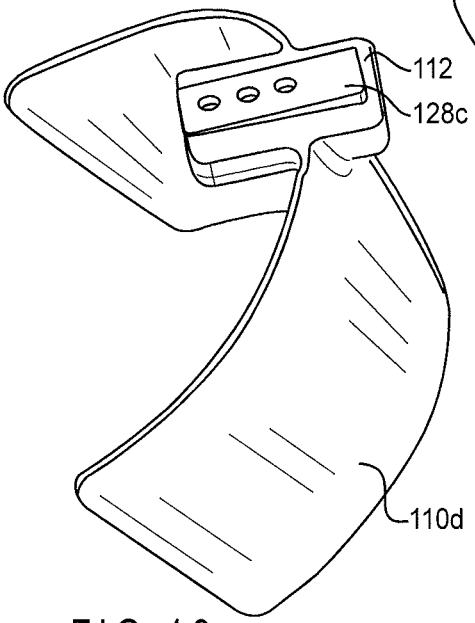
FIG. 19 is a right perspective view of a fifth embodiment of a visor and support structure for attachment to a baseball helmet in accordance with the present invention.
Figure 20:
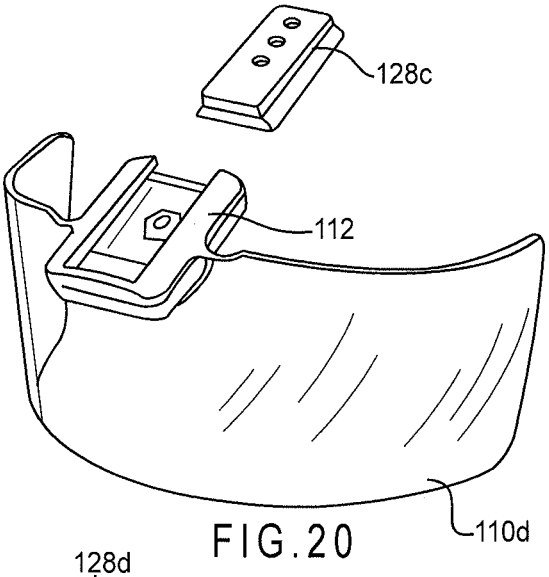
FIG. 20 is an exploded view of the visor and support structure of FIG. 19 when the visor is clear.

Another variation is shown in FIGS. 19-20, wherein the bracket 128 of FIGS. 1-3 and 5-8 is altered so that three holes are is formed along a central, longitudinally axis of the bracket 128 as shown with the bracket 128*c*. Attachment of the bracket 128*c* to the front bill 106 of the shell 102 is similar to the attachment of the bracket 128 to the bill 106 of FIGS. 1-3 and 5-8. In particular, three holes in the front bill 106 are formed so as to be aligned with the three holes of the bracket 128*c* and three screws 138 are inserted into the aligned holes so that the bracket 128*c* of FIG. 18 is attached to the underside of the front bill 106. Note that different types of visor shapes are possible. For example, FIG. 19 shows a tinted visor 110*d* without a recess 144 being present. FIG. 20 shows a clear visor 110*d* without a recess.

Figure 21:
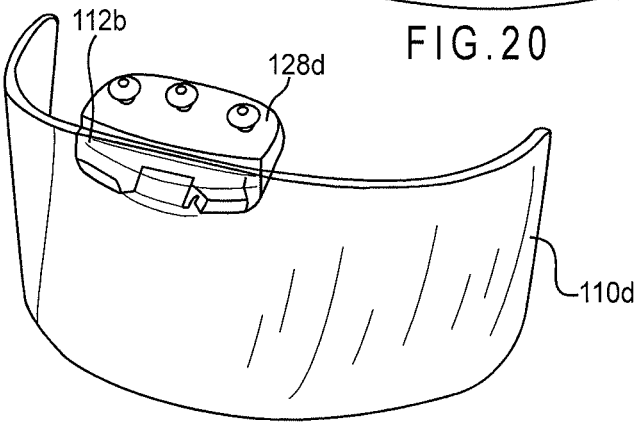
FIG. 21 is a left, top perspective view of a sixth embodiment of a visor and support structure for attachment to a baseball helmet in accordance with the present invention.

Another variation is shown in FIG. 21, wherein the bracket 128*c* of FIGS. 19-20 is longer in the direction connecting the surfaces 126. Accordingly, the width of the visor grip 112 is increased to take into account the shape of the revised bracket 122. As shown in FIG. 21, the altered bracket 128*d* has three holes formed along a central, longitudinally axis of the bracket 128*d*. Consequently, three holes are formed in the front bill 106 of the shell 102 so as to be aligned with the three holes of the bracket 122. Three screws are inserted into the aligned holes so that the bracket 128*d* is attached to the underside of the front bill 106. Note that revised visor grip 112*b* generally has the same cross-sectional shape as the visor grip 112 shown in FIG. 6*b*, except the width of the visor grip 112*b* is wider to accommodate the increased width of the bracket 128*c*. Insertion of the revised bracket 128*c* into the revised visor grip 112*b* is performed in a manner similar to the bracket 128 and visor grip 112 of FIGS. 1-3 and 5-8.

In another version, additional securement between the visor grips and brackets of FIGS. 1-21 is accomplished by riveting the visor grip and the bracket, when the bracket is positioned within the slot of the visor grip.

In another version, the slots of the visor grips of FIGS. 1-21 are eliminated. An upper face of the visor grip has a male or female attachment that engages a corresponding female or male attachment that is attached to the bottom surface of the bill 106 of the shell 102. Examples of possible male/female attachments are: 1) a male and female button system, 2) buckle with male and female ends, and 3) a mechanical ratchet.

In another version, the one, two and three screws for the helmets of FIGS. 1-21 are not used. Instead, the upper face of the bracket 128, 128*a-d* has an adhesive applied thereto. Then the upper face and adhesive thereon are attached to the underside of the bill 106 of the shell 102. Next, the visor grip 112, 112*a-b* of the visor 110, 110*a-d* engages the bracket 128, 128-*d* in a manner similar to that described previously with respect to FIGS. 1-21. In a similar variation, the adhesive is replaced by a Velcro piece that is attached to the upper face of the bracket 122, which engages a Velcro piece attached to the underside of the bill 106.

Figure 22:
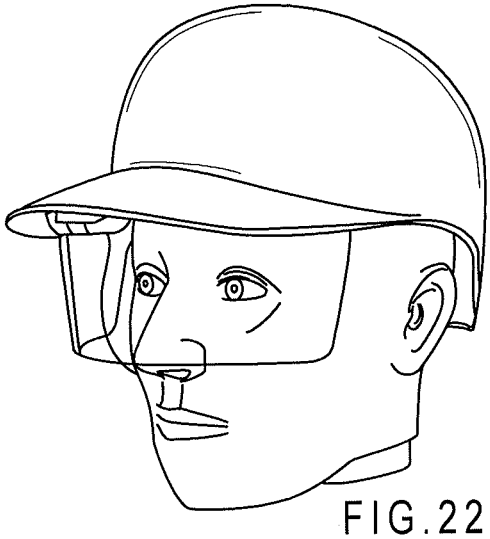
FIG. 22 is a left perspective view of a seventh embodiment of a visor and an attachment mechanism for attachment to a baseball helmet in accordance with the present invention.
Figure 24:
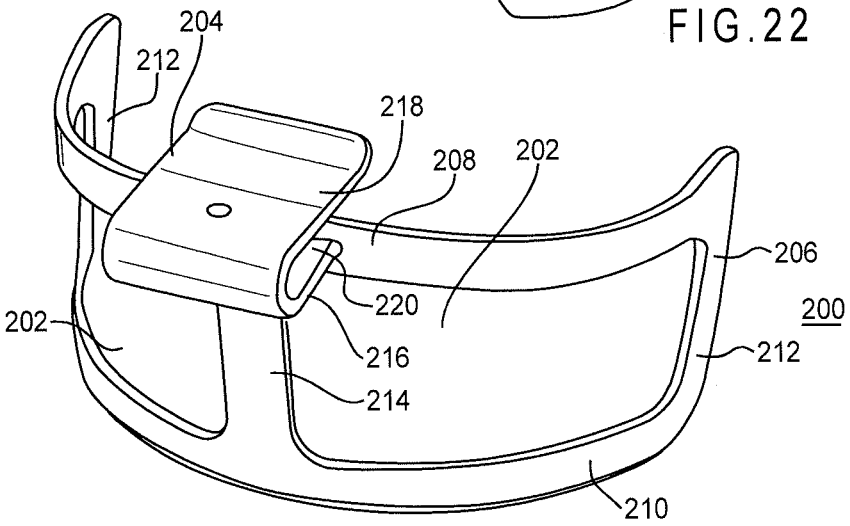
FIG. 24 is a left perspective view of a ninth embodiment of a visor and attachment mechanism for attachment to a baseball helmet in accordance with the present invention.
Figure 25:
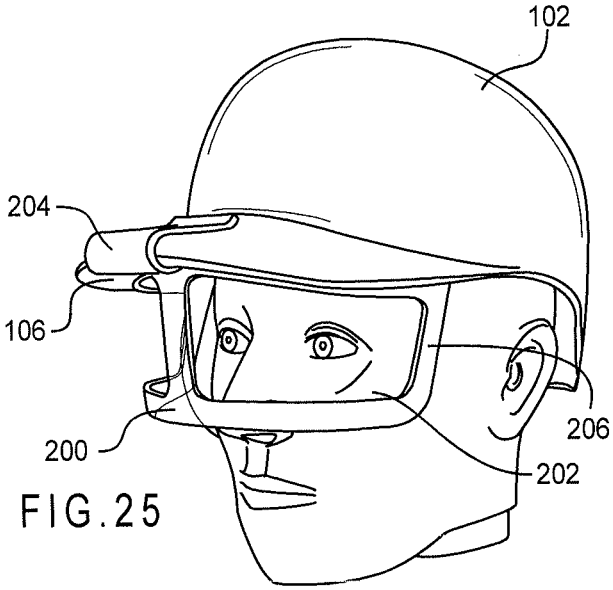
FIG. 25 is a left perspective view of an embodiment of a helmet that is attached to the visor via the attachment mechanism of FIG. 24.

In another version shown in FIG. 22, the visor grip 112, 112*a-b* is altered so as to have a top surface that is complementary to the shape of a central portion of the underside of the front bill 106. An adhesive is then applied to the top surface of the visor grip 112, 112*a-b* and then the top surface with adhesive is engaged with the central portion of the underside of the front bill 106.

Figure 23:
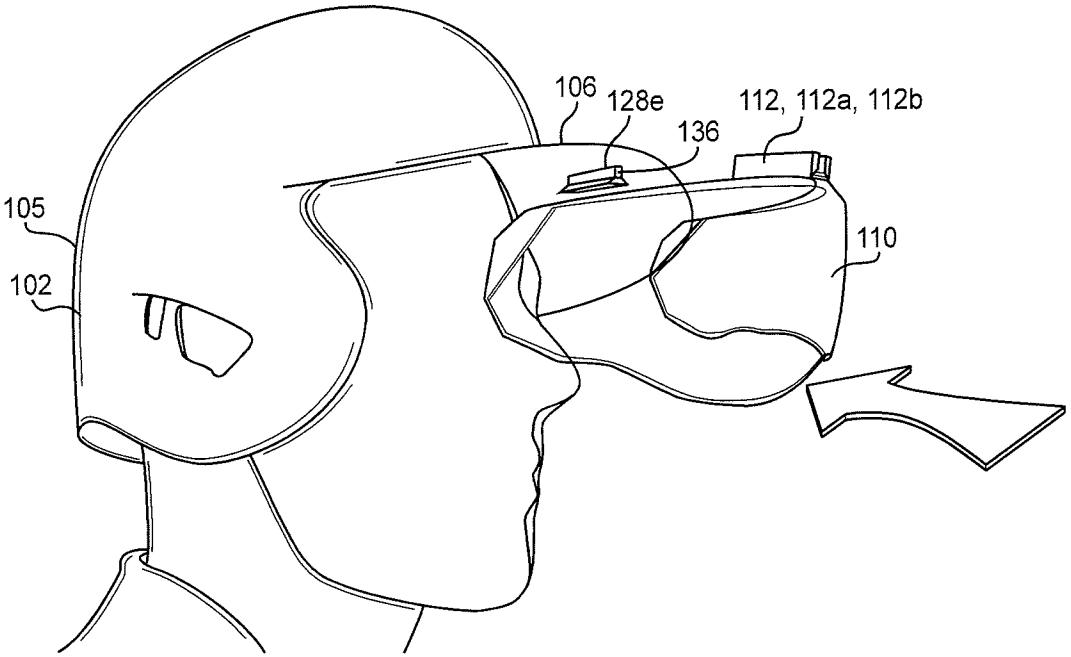
FIG. 23 is a right perspective view of an eighth embodiment of a visor and an attachment mechanism for attachment to a baseball helmet in accordance with the present invention.
Figure 26:
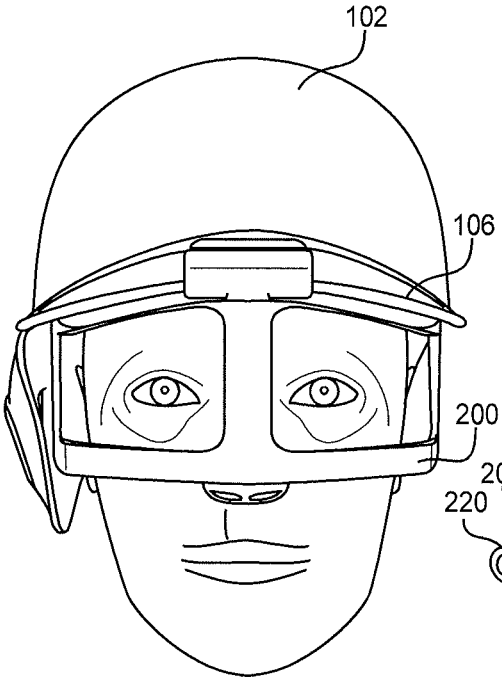
FIG. 26 is a front view of the helmet, visor, and attachment mechanism of FIG. 25.
Figure 27:
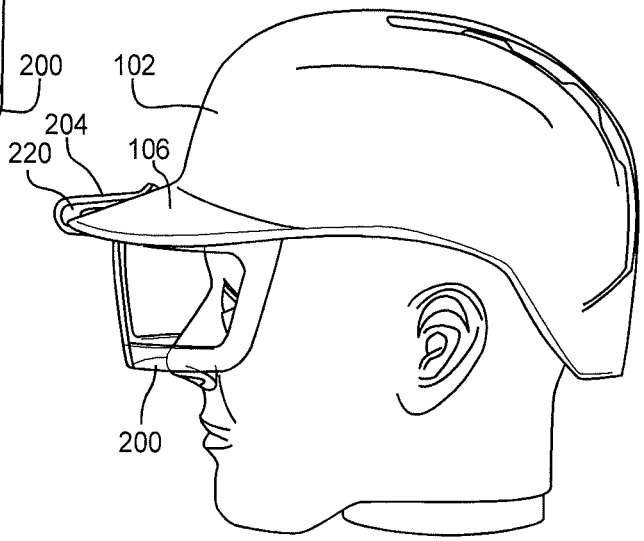
FIG. 27 is a left side view of the helmet, visor, and attachment mechanism of FIG. 25.
Figure 28:
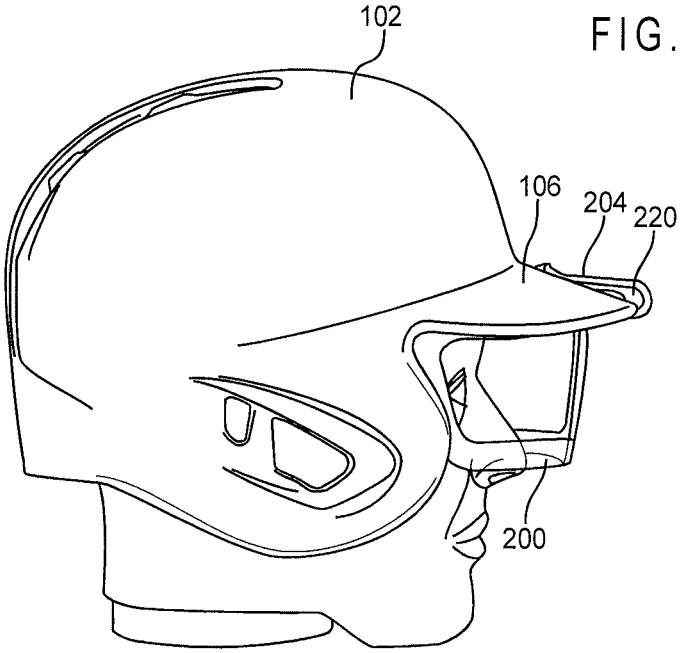
FIG. 28 is a right side view of the helmet, visor, and attachment mechanism of FIG. 25.

In the embodiments of FIGS. 1-22, the bracket 128, 128*a*, 128*b* is a piece separate from the front bill 106 and is attached to the front bill 106 via various elements, such as an adhesive, or screws. As schematically shown in FIG. 23, a variation of the brackets used in FIGS. 1-22 is to mold the helmets of FIGS. 1-22 so that the central underside of the bill 106 of the shell 102 of the helmet has a bracket 128*e* integral therewith that has a shape similar to that of brackets 128, 128*a*, 128*b*, 128*c* so as to engage the corresponding visor grips 112, 112*a-b* of FIGS. 1-22. Engagement between the molded bracket of FIG. 23 and the visor grips 112, 112*a-b* can be similar as the engagement between the brackets 128, 128*a-b* and the visor grips 112, 112*a-b* as described previously. For example, the molded bracket 128*e* of FIG. 23 can include a magnet 136 molded therein, which attractively engages a magnet 126 of the visor grip in a manner as disclosed previously.

Another variation is to not use magnets or an adhesive as in the embodiments of FIGS. 1-23. Such a variation is shown in FIGS. 24-28, wherein a visor 200 with clear or tinted eyepieces 202 is adapted for attachment to the front bill 106. The eyepieces 202 are made of a material similar to that of the visors of FIGS. 1-23. A clip 204 is integrally attached to the top, central portion of the frame 206 to which the eyepieces 202 are attached. The frame 206 has top and bottom sides 208, 210 that are integrally attached to one another via side pieces 212 and a centrally located vertical piece 214. The eyepieces 202 are attached to the inner surface of the frame 206 via an adhesive or other types of connections. The clip 204 and frame 206 may be made of plastic or a metal, such as steel. The clip 204 is J-shaped, wherein a short portion or arm 216 of the clip 204 is attached to the top, central portion of the frame 206. The long portion or arm 218 of the clip 204 is biased toward the frame 206. In addition, the long portion 218 and short portion 216 define a gap 220. The front bill 106 is inserted between the long and short portions 216, 218 of the clip so that the short portion 216 clamps upward against an underside of the front bill 106 and the long portion 218 clamps downward against an upper side of the front bill 106. Thus, the clip 204 clamps the visor 200 to the front bill 106. Removal of the visor 200 is accomplished by pulling the clip 204 away from the front bill 106. Note that a screw can be used to engage the top arm 218 and the front bill 106 by being inserted through and engaging aligned holes of the top arm 218 and front bill 106.

Figure 29:
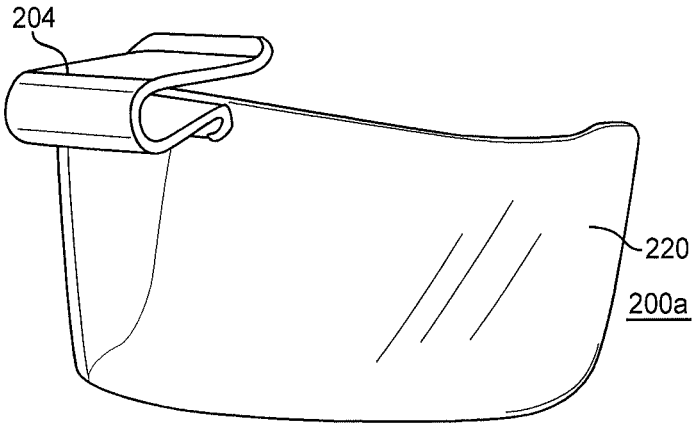
FIG. 29 is a left, front perspective view of a tenth embodiment of a visor and attachment mechanism for attachment to a baseball helmet in accordance with the present invention.
Figure 30:
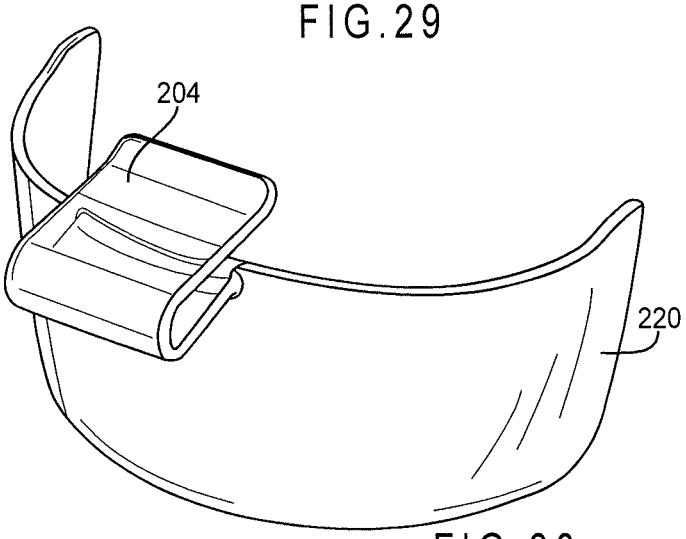
FIG. 30 is a top, left and front perspective view of the visor and attachment mechanism of FIG. 29.
Figure 31:
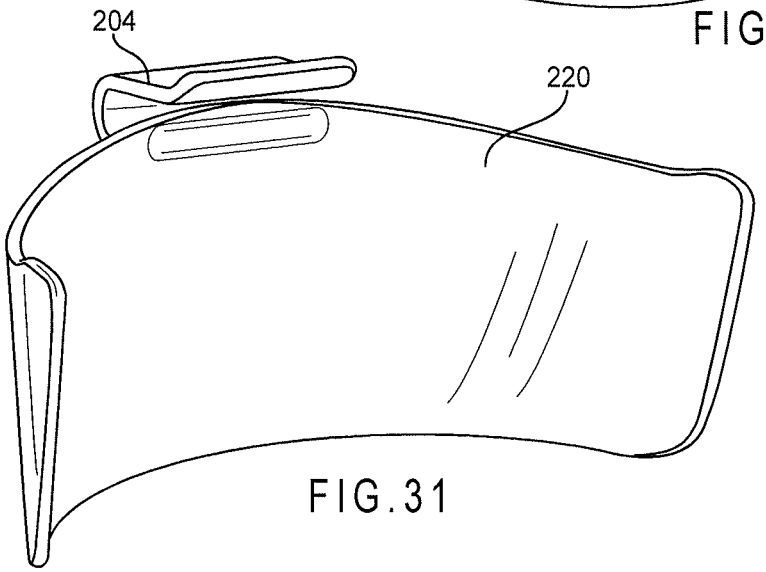
FIG. 31 is a top, left and rear perspective view of the visor and attachment mechanism of FIG. 29.

An alternative visor 200*a* is shown in FIGS. 29-31, wherein the frame 206 and eyepieces 202 of the visor 200 of FIGS. 24-28 have been replaced by a single sheet of clear or tinted material 220 that is integrally attached to the clip 204. The material 220 is made of a material similar to that of the visors of FIGS. 1-23. Attachment of the visor 200*a* is achieved in the same manner as describe with respect to the embodiment of FIGS. 24-28.

Figure 32:
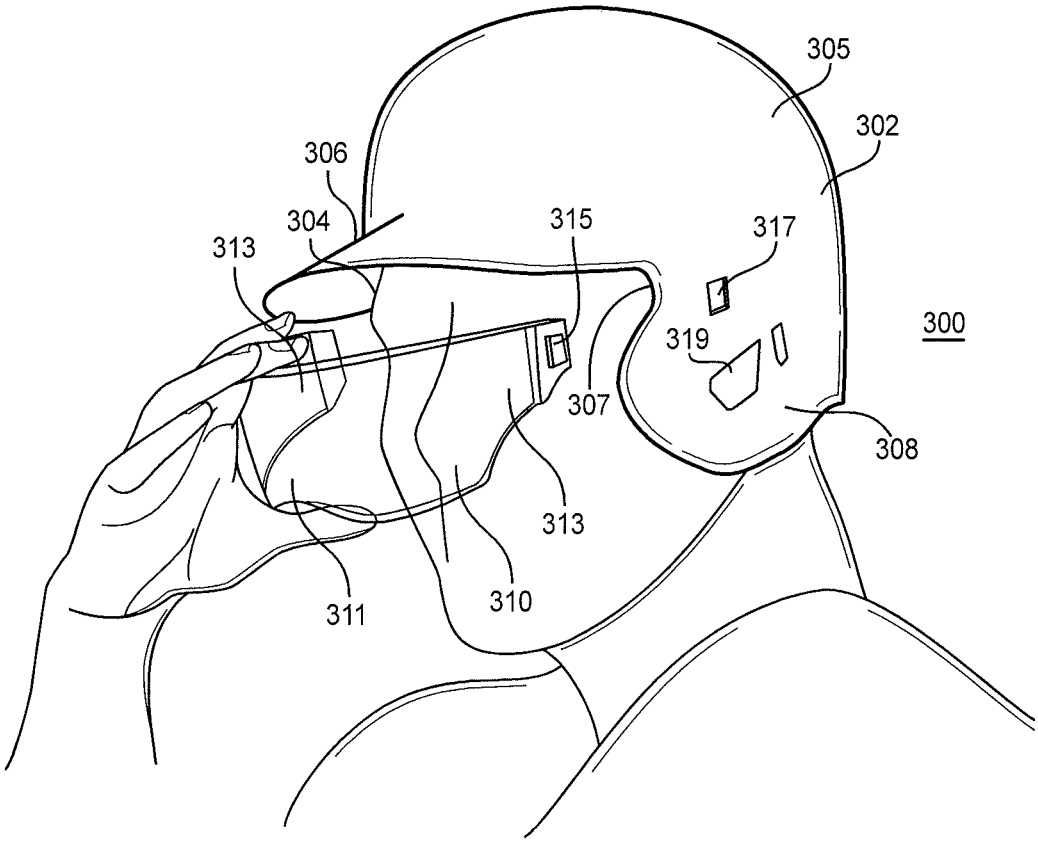
FIG. 32 is a left, front perspective view of an eleventh embodiment of a visor and attachment mechanism for attachment to a baseball helmet in accordance with the present invention.

Another variation of a helmet baseball helmet is shown in FIG. 32. In this embodiment, the baseball helmet 300 includes a hard shell 302 made of a durable material that is placed on the head 304 of a baseball player. The shell 302 defines an exterior surface 305 and an interior volume of space 307. As shown, the shell 302 includes a front bill 306 positioned at the front of the shell 302. The shell 302 can include an earflap 308 typically positioned on the side of the helmet 300 that will face the pitcher when the batter wearing the helmet 300 is in the batter's box. Of course, the shell 302 can include two earflaps, one for each ear.

The baseball helmet 300 includes a visor 310 attached thereto. The visor 310 is preferably made of a durable material, such as a polycarbonate that is injection molded. The material can be either clear/transparent or tinted to aid in reducing glare from the sun. The radius of curvature chosen for the optical portion 311 of the visor 310 depends on the optical characteristics to be conveyed to the player wearing the visor 310.

As shown in FIG. 32, the visor 310 is symmetric with respect to a vertical plane that bisects the central, front portion of the visor 320. The visor 310 has a pair of arms 313 that extend toward the shell 302. Each free end of an arm 313 has an exterior protrusion 315.

In order to attach the visor 310 to the shell 302, the user grabs the visor 310 and positions the visor 310 below the front bill 306 as shown in FIG. 32. Next, the user pushes the visor 310 towards the interior volume of space 307 of the shell 302. As the exterior protrusions 315 near the shell 302, they will be impeded from entering the interior volume of space 307 since they are spaced from one another by a distance that is greater than the width of the interior volume of space 307. At this point, the user squeezes the arms 313 towards each other by a sufficient amount so that the exterior protrusions 315 enter the interior volume of space 307. The user then moves and orients the visor 310 until the exterior protrusions 315 enter openings 317 formed in the sides of the shell 302. Such openings formed below the front bill 306 and above the ear opening(s) 319 should ear flap(s) form part of the shell 302. At this point, the user discontinues squeezing the arms 313 towards each other which results in the exterior protrusions 315 being spring loaded through the openings 317 so that a portion of each protrusion 315 extends past the exterior surface 305. The spring like action of the arms 313 and the fact the protrusions 315 snugly fit within the openings 317 results in attachment of the visor 310 to the shell 302. A clicking sound will be produced when a protrusion 315 snaps through an opening 317.

Detachment of the visor 310 from the shell 302 is accomplished by pressing the protrusions 315 by a sufficient amount so that the protrusions 315 pass through the openings 317 and are entirely within the interior volume of space 307. This pressing causes the arms 313 to be pressed towards each other as well. The visor 310 is then removed from the interior volume of space 307. After leaving the interior volume of space 307, the user can then discontinue pushing the arms 313 towards each other. As shown in FIG. 31, the exterior surface of each protrusion 315 can have indicia, such as the word "PUSH", that gives instructions on how to detach the visor 310.

Other variations of the helmet 300 are possible. For example, the interior sides of the ends of the arms 313 could have protrusions similar to protrusions 315, wherein attachment is achieved by having the arms 313 engage the exterior surface 305 and the protrusions are spring loaded into the openings 317 towards the interior volume of space 307. Alternatively, the above described protrusions of the arms 313 and openings of the shell 302 are switched with each other so that protrusions are formed on the shell and openings are formed at the ends of the arms 313 and attachment is achieved by having the protrusions inserted into the openings.

Figure 34:
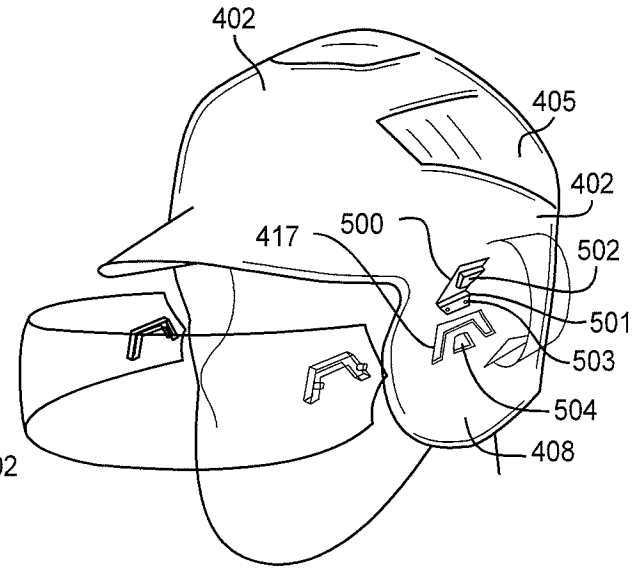
FIG. 34 is a left, front perspective view of a thirteenth embodiment of a visor and attachment mechanism for attachment to a baseball helmet in accordance with the present invention.
Figure 33:
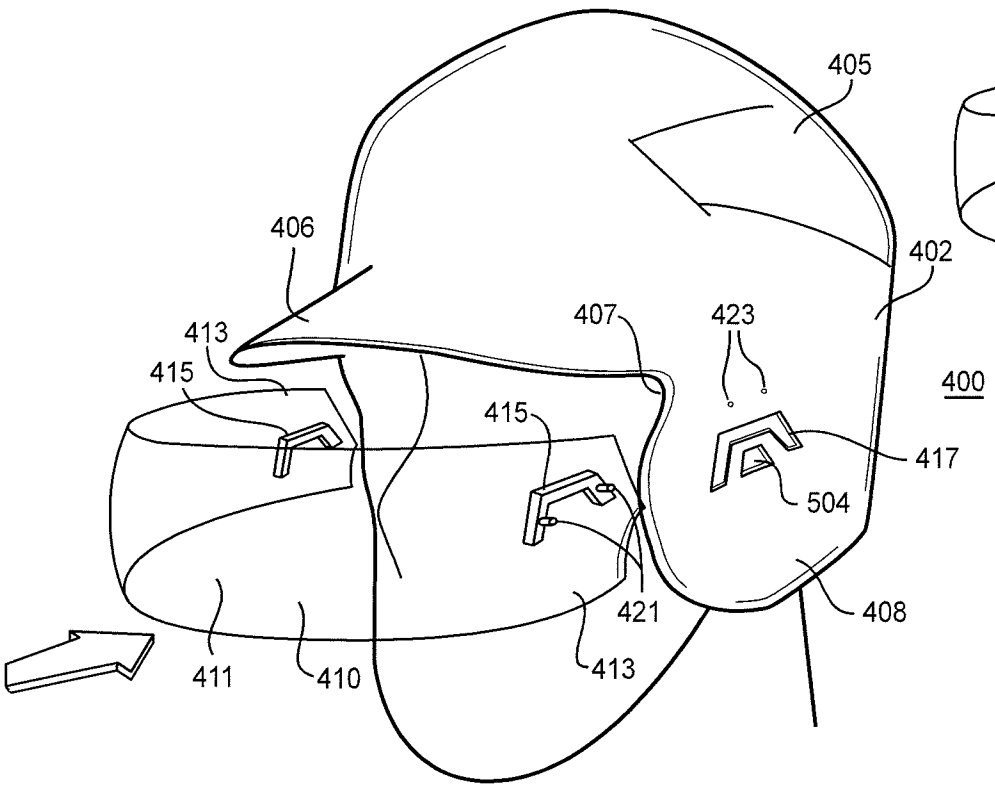
FIG. 33 is a left, front perspective view of a twelfth embodiment of a visor and attachment mechanism for attachment to a baseball helmet in accordance with the present invention.

Variations of the baseball helmet are shown in FIGS. 33-34. In the embodiment of FIG. 33, the baseball helmet 400 is similar to the baseball helmet 300 in that it includes a shell 402 that defines an exterior surface 405 and an interior volume of space 407. As shown, the shell 402 includes a front bill 406 positioned at the front of the shell 402. The shell 402 can include one or more earflaps 408 typically positioned over the ears of the batter.

The baseball helmet 400 includes a visor 410 attached thereto. The visor 410 is preferably made of a durable material, such as a polycarbonate that is injection molded. The material can be either clear/transparent or tinted to aid in reducing glare from the sun. The radius of curvature chosen for the optical portion 411 of the visor 410 depends on the optical characteristics to be conveyed to the player wearing the visor 410.

As shown in FIG. 33, the visor 410 is symmetric with respect to a vertical plane that bisects the central, front portion of the visor 410. The visor 410 has a pair of arms 413 that extend toward the shell 402. Like the arms 313 of the helmet 300 of FIG. 32, each free end of an arm 413 has protrusion 415, wherein the major difference is that the protrusions 415 have an inverted U-like shape and are mounted to the interior surfaces of the arms 413 via pegs 421 that are inserted into and attached to corresponding holes formed in the arms 413. The protrusions 415 can be made of a sturdy material, such as plastic, metal, or a carbon fiber.

In order to attach the visor 410 to the shell 402, the user grabs the visor 410 and positions the visor 410 below the front bill 406 as shown in FIG. 33. Next, the user pushes the visor 410 towards the interior volume of space 407 of the shell 402. As the interior protrusions 415 near the shell 402, they are prevented from overlapping the exterior surface 405 of the shell 402 since they are spaced from one another by a distance that is less than the width of the interior volume of space 407. At this point, the user spreads the arms 413 away from one another by a sufficient amount so that the interior protrusions 415 pass over the exterior surface 405. The user then moves and orients the visor 410 until the interior protrusions 415 enter openings 417 formed in the sides of the shell 402. Such openings are formed below the front bill 406. At this point, the user discontinues spreading the arms 413 away from each other which results in the interior protrusions 415 being spring loaded into the openings 417. The spring like action of the arms 413 and the fact the protrusions 415 snugly fit within the openings 417 results in attachment of the visor 410 to the shell 402.

Detachment of the visor 410 from the shell 402 is accomplished by grabbing the arms 413 and spreading them away from the exterior surface 405 by a sufficient amount so that the protrusions 415 are removed entirely from the openings 417. This spreading causes the arms 413 to be spread away from each other as well. The visor 410 is then moved past the exterior surface 405. After leaving the exterior surface 405, the user can then discontinue spreading the arms 413 away from each other.

Note that in an alternative embodiment shown in FIG. 34, the helmet 400 of FIG. 33 is altered so as to include a pair of covers 500 that are pivotably attached to a rectangular-like base 501 that has a pair of openings 503 that are aligned with holes 423 formed in the shell 402, wherein each cover 500 is attached above a corresponding opening 417 by inserting connecting elements, such as pegs (not shown), into the aligned openings 503 of the cover 500 and the corresponding holes 423 formed in the shell 402. When the visor 410 is attached to the shell 402 in the manner described previously, the cover 500 is rotated (see arrow in FIG. 34) to a closed position so as to cover and engage an upper portion 425 of the protrusion 415. The cover 500 has a male element 502 that snap engages an opening 504 of a similar shape so that the cover 500 is closed. When removal of the visor 410 is desired, the cover 500 is disengaged from the opening 504 and rotated to an open position shown in FIG. 34. At this point, the visor 410 is removed from the shell 402 in the same manner described previously with respect to the embodiment of FIG. 33.

Other variations of the helmets shown in FIGS. 33-34 are possible. For example, the exterior sides of the ends of the arms 413 could have protrusions similar to protrusions 415, wherein attachment is achieved by having the arms 413 inserted into the interior volume of space 407 and the protrusions 415 are spring loaded into the openings 417. Alternatively, the above described protrusions of the arms 413 and openings of the shell 402 are switched with each other so that protrusions are formed on the shell and openings are formed at the ends of the arms 413 and attachment is achieved by having the protrusions inserted into the openings.

Figures 35, 36:
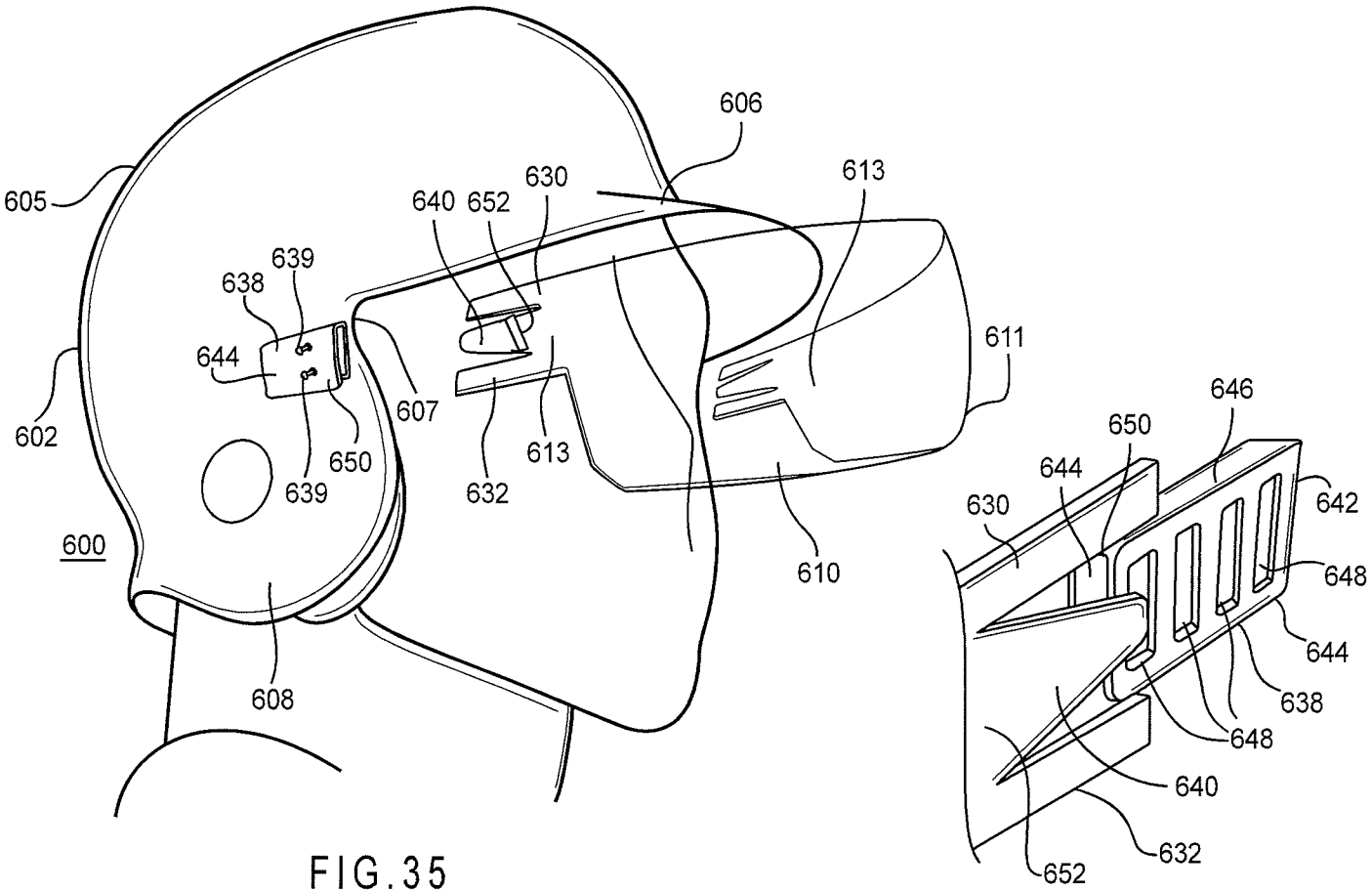
FIG. 35 is a right, front perspective view of a fourteenth embodiment of a visor and attachment mechanism for attachment to a baseball helmet in accordance with the present invention.
FIG. 36 is an enlarged perspective view of the attachment mechanism of FIG. 35.

Another embodiment of a baseball helmet is shown in FIGS. 35-36. The baseball helmet 600 is similar to the baseball helmet 300 of FIG. 32 in that it includes a shell 602 that defines an exterior surface 605 and an interior volume of space 607. As shown, the shell 602 includes a front bill 606 positioned at the front of the shell 602. The shell 602 can include one or more earflaps 608 typically positioned over the ears of the batter.

The baseball helmet 600 includes a visor 610 attached thereto. The visor 610 is preferably made of a durable material, such as a polycarbonate that is injection molded. The material can be either clear/transparent or tinted to aid in reducing glare from the sun. The radius of curvature chosen for the optical portion 611 of the visor 610 depends on the optical characteristics to be conveyed to the player wearing the visor 610.

As shown in FIG. 35, the visor 610 is symmetric with respect to a vertical plane that bisects the central, front portion of the visor 610. The visor 610 has a pair of arms 613 that extend toward the shell 602. Each free end of an arm 613 has three fingers 630, 632, 640.

In order to attach the visor 610 to the shell 602, the user grabs the visor 610 and positions the visor 610 below the front bill 606 as shown in FIG. 35. Next, the user pushes the visor 610 towards the interior volume of space 607 of the shell 602 in such a manner that the two outer fingers 630, 632 of each arm 613 are aligned to be above and below a mount 638. The middle finger 640 is aligned with a slot of the mount 638. Note that there are two mounts 638 that are attached to the interior sides of the shell 602 via screws or T-nuts 639 so as to be positioned below the front bill 606 as shown in FIG. 35. Note that the screws or T-nuts 639 are inserted through the exterior of the shell 602 so as to penetrate the mount 638. Also, other ways to attach the mount 638 to the interior of the shell 602 are possible, such as by using glue or having the mount integrally formed with the shell 602. As shown in FIG. 36, the mount has an inverted U-like shape defined by side walls 642, 644 integrally attached to a top wall 646. The side wall 644 is adjacent the interior surface of the shell 602 and is attached thereto by the screws 639. The side wall 642 has a plurality of rectangular openings 648 that are equally spaced from each other along the length of the mount 638.

Once the fingers 630, 632, and 640 are aligned with the mounts 638, the visor 610 is pushed so that the fingers 640 engages the mounts 638 and the outer fingers 630, 632 are adjacent to the upper and lower portions of the mount 638. The engagement between a finger 640 and the mount 638 is such that the finger 640 can be locked into various discrete and incremental lateral positions along a longitudinal direction of the mount 638. Thus, the distance between the visor 610 and the eyes of the user can be adjusted. Such engagement entails inserting the finger 640 into the slot 650 defined by the mount 638 and inserting a ridge/ratchet 652 of the finger 640 into one of the openings/detents 648 (3 to 10 in number) in a snug-like manner so that a desired distance between the visor 610 and the face of the batter is achieved. Such attachment is like the ratcheting/detent mechanism used in ski boots or roller blades. A desired position for the visor 610 is achieved by inserting the ridge/ratchet 652 in a particular opening 648. Note that the finger 640 is biased into the opening 648 in a spring-like manner so that attachment is achieved.

Detachment of the visor 610 from the shell 602 is accomplished by pushing the ridge 652 out of the opening 648 and then pulling the finger 640 out of the slot 650.

Other variations of the helmet 600 of FIGS. 35-36 are possible. For example, the mount 638 could be attached to the exterior of the shell 602 and the visor 610 could be dimensioned so that the fingers 630, 632, 640 interact with the mount 638 in the manner described previously. Also, the fingers 630, 632, 640 could be mounted to the shell while the mount is mounted to the arms of the visor 610 and attachment is achieved in a manner similar as that described previously.

Figure 38:
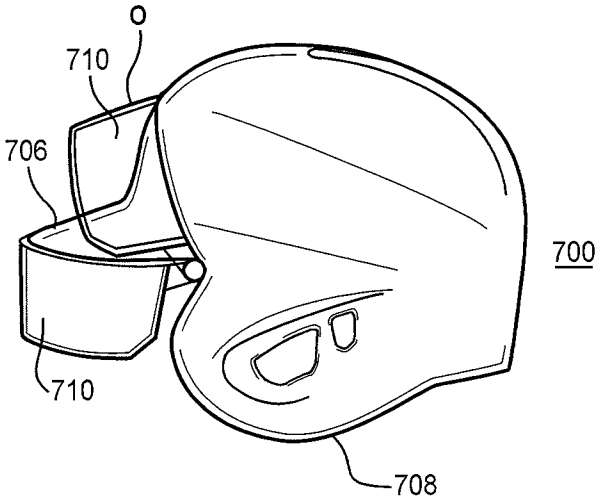
FIG. 38 is a left view of the visor and attachment of FIG. 37, wherein the visor in different positions is shown.
Figure 37:
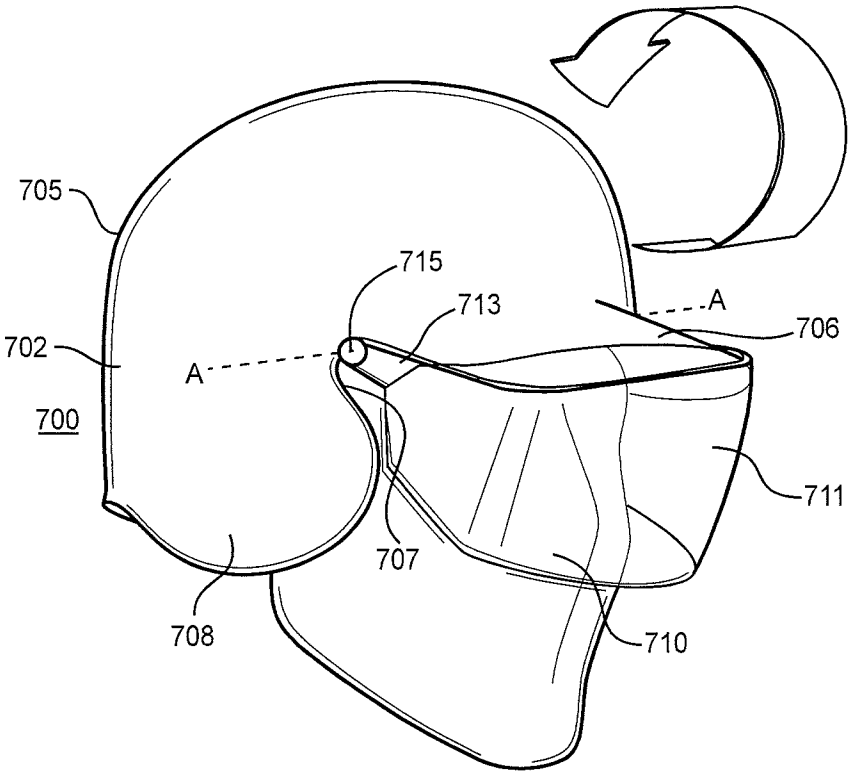
FIG. 37 is a right, front perspective view of a fifteenth embodiment of a visor and attachment mechanism for attachment to a baseball helmet in accordance with the present invention.

Another embodiment of a baseball helmet is shown in FIGS. 37-38. The baseball helmet 700 is similar to the baseball helmet 300 of FIG. 32 in that it includes a shell 702 that defines an exterior surface 705 and an interior volume of space 707. As shown, the shell 702 includes a front bill 706 positioned at the front of the shell 702. The shell 702 can include one or more earflaps 708 typically positioned over the ears of the batter.

The baseball helmet 700 includes a visor 710 attached thereto. The visor 710 is preferably made of a durable material, such as a polycarbonate that is injection molded. The material can be either clear/transparent or tinted to aid in reducing glare from the sun. The radius of curvature chosen for the optical portion 711 of the visor 710 depends on the optical characteristics to be conveyed to the player wearing the visor 710.

As shown in FIG. 37, the visor 710 is symmetric with respect to a vertical plane that bisects the central, front portion of the visor 710. The visor 710 has a pair of arms 713 that extend toward the shell 702. Each free end of an arm 713 has an opening (not shown) that receives a male element 715. The male element 715 can have a ratcheting/friction mechanism (not shown) that allows the male element 715 to rotate to and be locked in place at particular angular positions. Since the male element 715 is integral with the visor 710, the visor 710 will be able to rotate/pivot to various angular positions about the axis A as represented by the arrow of FIG. 37, where it can be locked in position. The male element 715 is similarly inserted into an opening formed in the shell 702 near the rear side portion of the front bill 706. Note that the openings in the shell 702 are aligned along the axis A that intersects the left and right sides of the shell 702 that are opposite each other with respect to the vertical plane mentioned previously that bisects the visor 710 and the axis A is preferably perpendicular to the same vertical plane. As shown in FIG. 38, the visor 710 can be rotated clockwise to an open position O so that it abuts a front portion of the shell 702.

As shown in FIGS. 37-38, the visor 710 can be rotated to a closed position where the visor 710 is positioned in front of the eyes of the batter. Note that the top portion of the visor 710 has a ridge 717 that acts as a stop when rotated to the closed position. In particular, when the visor 710 is rotated to the closed position, the ridge 717 engages the front, top portion of the front bill 706 to such an extent that the visor 710 cannot be further rotated.

Figure 40:
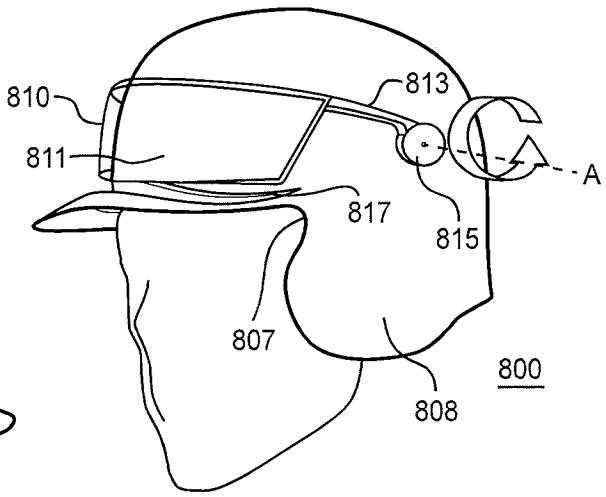
FIG. 40 is a left, perspective view of the visor and attachment of FIG. 39, wherein the visor in different positions is shown.
Figure 39:
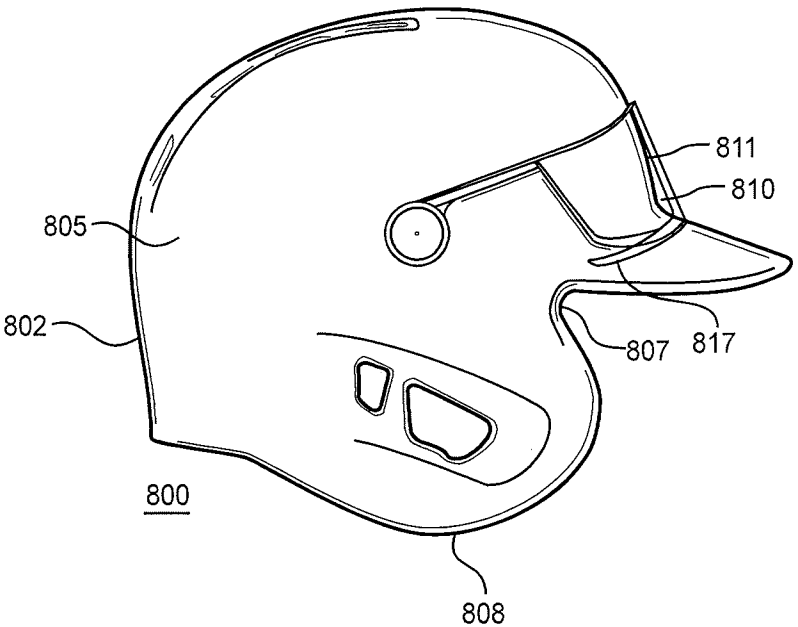
FIG. 39 is a right, side view of a sixteenth embodiment of a visor and attachment mechanism for attachment to a baseball helmet in accordance with the present invention.

Another embodiment of a baseball helmet is shown in FIGS. 39-40. The baseball helmet 800 is similar to the baseball helmet 300 of FIG. 32 in that it includes a shell 802 that defines an exterior surface 805 and an interior volume of space 807. As shown, the shell 802 includes a front bill 806 positioned at the front of the shell 802. The shell 802 can include one or more earflaps 808 typically positioned over the ears of the batter.

The baseball helmet 800 includes a visor 810 attached thereto. The visor 810 is preferably made of a durable material, such as a polycarbonate that is injection molded. The material can be either clear/transparent or tinted to aid in reducing glare from the sun. The radius of curvature chosen for the optical portion 811 of the visor 810 depends on the optical characteristics to be conveyed to the player wearing the visor 810.

As shown in FIGS. 39-40, the visor 810 is symmetric with respect to a vertical plane that bisects the central, front portion of the visor 810. The visor 810 has a pair of arms 813 that extend toward the shell 802. Each free end of an arm 813 has a male element 815 that is attached to the interior of the shell 802 by a connection element, such as a screw/t-nut (not shown). The male element 815 is inserted into an opening formed in the shell 802. The openings in the shell 802 are aligned along an axis A that is preferably perpendicular to the vertical plane mentioned previously that bisects the visor 810. The male element 815 is attached to the shell 802 so that the visor 810 is able to rotate about the axis A as represented by the arrow of FIG. 40. As shown in FIGS. 39-40, the visor 810 can be rotated counter-clockwise to an open position so that it is positioned adjacent to a front portion of the shell 802 and above the front bill 806.

At the open position, the visor 810 can be rotated clockwise to a closed position where the visor 810 is positioned in front of the eyes of the batter. During such rotation, the central portion of the visor 810 passes through an arcuate slot 817 formed in the shell 802 at a rear portion of the front bill 806. When the arms 813 contact the portions of the shell 802 positioned to the left and right sides of the slot 817, further rotation is prevented. The portions of the arms 813 that contact the shell act as stops that limit further rotation.

For the embodiments of FIGS. 1-21, 23 and 26-36, one possible way of using the described helmets and visors is to have the visor attached to the front bill 106 and wear the helmet while batting in the batting box. Once the at bat is completed, the visor can be removed from the front bill in the manner described previously.

As another possibility, a hinge could be attached to the underside of the bill 106. The visors of FIGS. 1-21 and 23-31, without the visor grips or clips, would be attached to the hinge so that the visors could pivot to a first position in front of the face of the user as shown in FIGS. 1-21 and 23-31 and a second position where the visor does not block the face of the user.

Regarding the embodiments of FIGS. 37-40, one possible way of using the described helmets and visors is to have the visor rotated to the closed position where the visor is in front of the eyes of the batter and wear the helmet while batting in the batting box. Once the at bat is completed, the visor can be rotated to an open position so as to not be positioned in front of the eyes of the batter in the manner described previously.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

We claim:

1. A helmet comprising:

a hard shell defining an exterior surface and an interior volume of space and comprising a bill;

a support structure attached to an underside of said bill;

a visor comprising an engagement structure that is releasably attached to said support structure, wherein said engagement structure and said support structure are configured such that when said engagement structure is relasably attached to said support structure said visor does not pivot relative to said support structure, wherein said engagement structure comprises:

walls that define a slot into which said support structure is slidingly inserted so that said interior volume of space approaches said slot and said walls engage and hold said support structure in position; and a magnet that releasably engages said support structure; and wherein said support structure comprises a second magnet that releasably engages said magnet of said engagement structure.

2. The helmet of claim 1, wherein said support structure is attached to said bill by at least one screw.

3. The helmet of claim 1, wherein said support structure is attached to said bill by an adhesive.

4. The helmet of claim 1, wherein said visor is clear.

5. The helmet of claim 1, wherein said visor is tinted.

6. The helmet of claim 1, wherein said support structure is molded to said underside of said bill.

7. The helmet of claim 1, wherein said hard shell comprises an earflap.

8. The helmet of claim 1, wherein said engagement structure comprises:

a first side wall that extends from a top of said visor toward a front portion of said bill, wherein said first side wall defines a first groove;

a second side wall that extends from said top of said visor toward said front portion of said bill, wherein said second side wall defines a second groove that is spaced from and faces said first groove.

9. The helmet of claim 1, wherein said support structure is supported on a bottom exterior surface of said bill, said support structure comprising a first ramped surface and a second ramped surface that faces away from said first ramped surface.

10. The helmet of claim 9, comprising a screw that extends through said support structure and engages said bill.

11. A helmet comprising:

a hard shell defining an exterior surface and an interior volume of space and comprising a bill;

a support structure attached to an underside of said bill;

a visor comprising an engagement structure that is releasably attached to said support structure, wherein said engagement structure and said support structure are configured such that when said engagement structure is releasably attached to said support structure said visor does not pivot relative to said support structure, wherein said engagement structure comprises:

walls that define a slot into which said support structure is slidingly inserted so that said interior volume of space approaches said slot and said walls engage and hold said support structure in position; and a magnet that releasably engages said support structure; and wherein said support structure is supported on a bottom exterior surface of said bill, said support structure comprising a first ramped surface and a second ramped surface that faces away from said first ramped surface;

wherein said support structure defines an indentation that receives a second magnet.

12. A helmet comprising:

a hard shell defining an exterior surface and an interior volume of space and comprising a bill;

a support structure attached to an underside of said bill;

a visor comprising an engagement structure that is releasably attached to said support structure, wherein said engagement structure and said support structure are configured such that when said engagement structure is releasably attached to said support structure said visor does not pivot relative to said support structure, wherein said engagement structure comprises:

walls that define a slot into which said support structure is slidingly inserted so that said interior volume of space approaches said slot and said walls engage and hold said support structure in position; and a magnet that releasably engages said support structure;

wherein said walls of said engagement structure comprise:

a first side wall that extends from a top of said visor toward a front portion of said bill, wherein said first side wall defines a first groove;

a second side wall that extends from said top of said visor toward said front portion of said bill, wherein said second side wall defines a second groove that is spaced from and faces said first groove;

wherein said support structure is supported on a bottom exterior surface of said bill, said support structure comprising a first ramped surface and a second ramped surface that faces away from said first ramped surface and wherein said first ramped surface is received by said first groove and said second ramped surface is received by said second groove.

13. The helmet of claim 12, comprising a screw that extends through said support structure and engages said bill.

14. The helmet of claim 12, wherein said support structure defines a first indentation that receives a second magnet; and wherein said engagement structure defines a second indentation that receives said magnet, wherein said magnet is adapted to be attracted to said second magnet.

* * * * *